US009523933B2

(12) United States Patent
Masoud, Jr. et al.

(10) Patent No.: US 9,523,933 B2
(45) Date of Patent: Dec. 20, 2016

(54) METHODS OF PRINTING AND ELECTROSTATIC INK COMPOSITIONS

(71) Applicant: Hewlett-Packard Indigo B.V., Amstelveen (NL)

(72) Inventors: Emad Masoud, Jr., Nes Ziona (IL); Yael Kowal-Blau, Nes Ziona (IL); Albert Teishev, Nes Ziona (IL); Ilanit Mor, Nes Ziona (IL); Nurit Carmel-Barnea, Nes Ziona (IL); Julia Kornilov, Nes Ziona (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 71 days.

(21) Appl. No.: 14/443,895

(22) PCT Filed: Nov. 20, 2012

(86) PCT No.: PCT/EP2012/073108

§ 371 (c)(1),
(2) Date: May 19, 2015

(87) PCT Pub. No.: WO2014/079480

PCT Pub. Date: May 30, 2014

(65) Prior Publication Data

US 2015/0301465 A1 Oct. 22, 2015

(51) Int. Cl.
*G03G 9/13* (2006.01)
*G03G 9/087* (2006.01)
(Continued)

(52) U.S. Cl.
CPC ..... *G03G 9/08733* (2013.01); *B41J 2/06* (2013.01); *B41J 2/41* (2013.01); *G03G 9/08* (2013.01);
(Continued)

(58) Field of Classification Search
CPC ..... G03G 9/133
See application file for complete search history.

(56) References Cited

U.S. PATENT DOCUMENTS 7,098,265 B2 8/2006 Qian et al.
7,851,518 B2 12/2010 Doi et al.
(Continued)

FOREIGN PATENT DOCUMENTS

EP 0740217 10/1996
EP 2088175 8/2009
(Continued)

OTHER PUBLICATIONS

International Search Report and Written Opinion dated Aug. 26, 2013 for International Application No. PCT/EP2012/073108 filed Nov. 20, 2013, Applicant Hewlett-Packard Indigo B.V.
(Continued)

*Primary Examiner* — Hoa V Le
(74) *Attorney, Agent, or Firm* — HP Inc. Patent Department

(57) ABSTRACT

Methods of Printing and Electrostatic Ink Compositions Herein are disclosed electrostatic ink compositions, methods of printing and printed substrates. In some examples, the electrostatic ink composition comprises a carrier liquid, particles comprising a graft co-polymer comprising an acrylate polymer backbone onto which has been grafted polysiloxane side chains, wherein the particles are dispersed in the carrier liquid.

14 Claims, 2 Drawing Sheets

(51) Int. Cl.

| | |
|---|---|
| ***B41J 2/06*** | (2006.01) |
| ***B41J 2/41*** | (2006.01) |
| ***G03G 9/08*** | (2006.01) |
| ***G03G 9/125*** | (2006.01) |
| *G03G 15/10* | (2006.01) |

(52) U.S. Cl.
CPC ..... *G03G 9/087* (2013.01); *G03G 9/125* (2013.01); *G03G 9/132* (2013.01); *G03G 9/133* (2013.01); *G03G 15/10* (2013.01)

(56) References Cited

U.S. PATENT DOCUMENTS

| | | | |
|---|---|---|---|
| 8,055,160 | B2 | 11/2011 | Bhattacharyya et al. |
| 2007/0039502 | A1 | 2/2007 | Bieber et al. |
| 2009/0104556 | A1 | 4/2009 | Grierson et al. |
| 2009/0311614 | A1 | 12/2009 | Almog et al. |

FOREIGN PATENT DOCUMENTS

| | | |
|---|---|---|
| WO | 2007108485 | 9/2007 |
| WO | 2007130069 | 11/2007 |

OTHER PUBLICATIONS

Bluestar Silicones, Mirasil Silicone Product Selector Guide, May 2012.

SiSiB Silicone Fluids, http://www.powerchemical.net/silicone_fluid/phenyl_silicone_fluid.html, pp. 1-6, issued Oct. 3, 2012.

Shin-Etsu Silicones, KSG-15, http://www.shinetsusilicones.com/content/ksg-15, issued Oct. 3, 2012.

Shin-Etsu Silicone, http://www.silicone.jp/e/products/type/mold/index.shtml, issued Oct. 3, 2012.

Shin-Etsu Technical Data Sheet, Version Oct. 19, 2012, KP-561P, Silicone Acrylate, pp. 1-2.

Momentive, Material Safety Data Sheet, Silwet* L-7510 copolymer, Siloxane Polyalkyleneoxide copolymer, Version 1, May 10, 2007.

METHODS OF PRINTING AND ELECTROSTATIC INK COMPOSITIONS

BACKGROUND

Electrostatic printing processes typically involve creating an image on a photoconductive surface, applying an ink having charged particles to the photoconductive surface, such that they selectively bind to the image, and then transferring the charged particles in the form of the image to a print substrate.

The photoconductive surface is typically on a cylinder and is often termed a photo imaging plate (PIP). The photoconductive surface is selectively charged with a latent electrostatic image having image and background areas with different potentials. For example, an electrostatic ink composition comprising charged toner particles in a carrier liquid can be brought into contact with the selectively charged photoconductive surface. The charged toner particles adhere to the image areas of the latent image while the background areas remain clean. The image is then transferred to a print substrate (e.g. paper) directly or, more commonly, by being first transferred to an intermediate transfer member, which can be a soft swelling blanket, and then to the print substrate.

DETAILED DESCRIPTION

Figure 1:
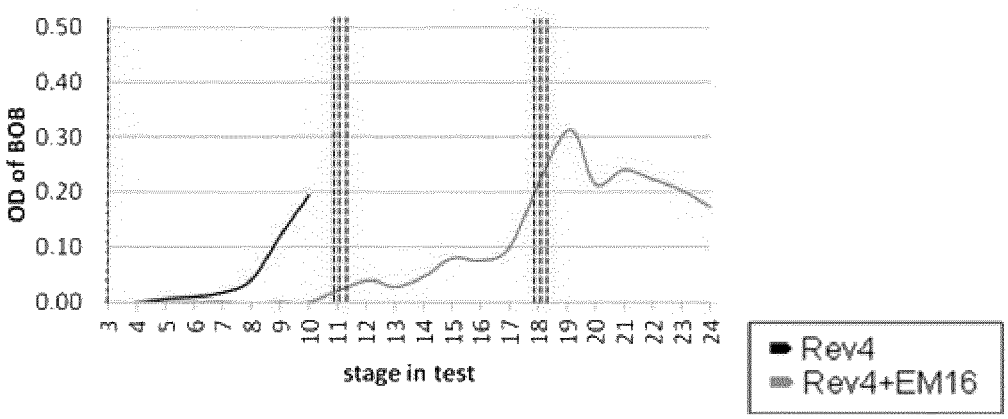
FIG. 1 shows the results of test on an example ink composition as described herein. In particular, this Figure shows 'background accumulation on blanket' (BOB). At the end of each stage, the BOB is cleaned off the blanket and measured. The graph of this Figure shows the delayed increase in background accumulation due to the addition of a graft co-polymer comprising an acrylate polymer backbone onto which has been grafted polysiloxane side chains.

Before the present invention is disclosed and described, it is to be understood that this disclosure is not limited to the particular process steps and materials disclosed herein because such process steps and materials may vary somewhat. It is also to be understood that the terminology used herein is used for the purpose of describing particular embodiments. The terms are not intended to be limiting because the scope is intended to be limited by the appended claims and equivalents thereof.

It is noted that, as used in this specification and the appended claims, the singular forms "a," "an," and "the" include plural referents unless the context clearly dictates otherwise.

As used herein, "carrier liquid," "carrier," or "carrier vehicle" refers to the fluid in which the polymers, particles, colorant, charge directors and other additives can be dispersed to form a liquid electrostatic ink or electrophotographic ink. The carrier liquids may include a mixture of a variety of different agents, such as surfactants, co-solvents, viscosity modifiers, and/or other possible ingredients.

As used herein, "electrostatic ink composition" generally refers to a ink composition in liquid form that is typically suitable for use in an electrostatic printing process, sometimes termed an electrophotographic printing process. The electrostatic ink composition may comprise chargeable particles of a resin, which may be as described herein, dispersed in a carrier liquid, which may be as described herein.

As used herein, "pigment" generally includes pigment colorants, magnetic particles, aluminas, silicas, and/or other ceramics or organo-metallics, whether or not such particulates impart color. Thus, though the present description primarily exemplifies the use of pigment colorants, the term "pigment" can be used more generally to describe not just pigment colorants, but other pigments such as organometallics, ferrites, ceramics, etc.

As used herein, "co-polymer" refers to a polymer that is polymerized from at least two monomers.

As used herein, "melt flow rate" generally refers to the extrusion rate of a resin through an orifice of defined dimensions at a specified temperature and load, usually reported as temperature/load, e.g. 190° C./2.16 kg. Flow rates can be used to differentiate grades or provide a measure of degradation of a material as a result of molding. In the present disclosure, "melt flow rate" is measured per ASTM D1238-04c Standard Test Method for Melt Flow Rates of Thermoplastics by Extrusion Plastometer, as known in the art. If a melt flow rate of a particular polymer is specified, unless otherwise stated, it is the melt flow rate for that polymer alone, in the absence of any of the other components of the electrostatic ink composition.

As used herein, "acidity," "acid number," or "acid value" refers to the mass of potassium hydroxide (KOH) in milligrams that neutralizes one gram of a substance. The acidity of a polymer can be measured according to standard techniques, for example as described in ASTM D1386. If the acidity of a particular polymer is specified, unless otherwise stated, it is the acidity for that polymer alone, in the absence of any of the other components of the liquid toner composition.

As used herein, "melt viscosity" generally refers to the ratio of shear stress to shear rate at a given shear stress or shear rate. Testing is generally performed using a capillary rheometer. A plastic charge is heated in the rheometer barrel and is forced through a die with a plunger. The plunger is pushed either by a constant force or at constant rate depending on the equipment. Measurements are taken once the system has reached steady-state operation. One method used is measuring Brookfield viscosity @ 140° C., units are mPa-s or cPoise, as known in the art. Alternatively, the melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate. If the melt viscosity of a particular polymer is specified, unless otherwise stated, it is the melt viscosity for that polymer alone, in the absence of any of the other components of the liquid toner composition.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "electrostatic printing" or "electrophotographic printing" generally refers to the process that provides an image that is transferred from a photo imaging substrate either directly or indirectly via an intermediate transfer member to a print substrate. As such, the image is not substantially absorbed into the photo imaging substrate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid ink is employed in the electrophotographic process rather than a powder toner. An electrostatic printing process may involve subjecting the electrostatic ink composition to an electric field, e.g. an electric field having a field gradient of 50-400V/μm, or more, ins some examples 600-900V/μm, or more.

As used herein, "substituted" may indicate that a hydrogen atom of a compound or moiety is replaced by another atom such as a carbon atom or a heteroatom, which is part of a group referred to as a substituent. Substituents include, for example, alkyl, alkoxy, aryl, aryloxy, alkenyl, alkenoxy, alkynyl, alkynoxy, thioalkyl, thioalkenyl, thioalkynyl, thioaryl, etc.

As used herein, "heteroatom" may refer to nitrogen, oxygen, halogens, phosphorus, or sulfur.

As used herein, "alkyl", or similar expressions such as "alk" in alkaryl, may refer to a branched, unbranched, or cyclic saturated hydrocarbon group, which may, in some examples, contain from 1 to about 50 carbon atoms, or 1 to about 40 carbon atoms, or 1 to about 30 carbon atoms, or 1 to about 10 carbon atoms, or 1 to about 5 carbon atoms for example.

The term "aryl" may refer to a group containing a single aromatic ring or multiple aromatic rings that are fused together, directly linked, or indirectly linked (such that the different aromatic rings are bound to a common group such as a methylene or ethylene moiety). Aryl groups described herein may contain, but are not limited to, from 5 to about 50 carbon atoms, or 5 to about 40 carbon atoms, or 5 to 30 carbon atoms or more, and may be selected from, phenyl and naphthyl.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not just the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

In a first aspect, there is provided a method of printing, the method comprising providing an electrostatic ink composition comprising a carrier liquid, and particles comprising a graft co-polymer comprising an acrylate polymer backbone onto which has been grafted polysiloxane side chains, wherein the particles are dispersed in the carrier liquid;

forming a latent electrostatic image on a surface;

contacting the surface with the electrostatic ink composition, such that at least some of the particles are transferred to the surface to form a developed toner image on the surface; and transferring the toner image from the surface to a print substrate.

In a second aspect, there is provided an electrostatic ink composition comprising a carrier liquid, particles comprising a graft co-polymer comprising an acrylate polymer backbone onto which has been grafted polysiloxane side chains, wherein the particles are dispersed in the carrier liquid.

In a third aspect, there is provided print substrate having printed thereon an electrostatic ink comprising a graft co-polymer comprising an acrylate polymer backbone onto which has been grafted polysiloxane side chains.

It has been found that the inclusion of a graft co-polymer comprising an acrylate polymer backbone onto which has been grafted polysiloxane side chains can improve the transfer of an ink from an intermediate transfer member to a print substrate. It has also been found that the addition of such a graft co-polymer can improve the adhesion of inks to a print substrate and the scratch resistance of the printed inks.

Various example features of the aspects are described below. Unless otherwise indicated, any of the features described below may be combined with any of the aspects described herein or any of the other features described below.

In some examples, the graft co-polymer has hydrocarbon-containing, e.g. alkyl-containing, side chains. The hydrocarbon-containing side chains, e.g. alkyl-containing side chains, may contain groups containing at least 10 carbon atoms, in some examples from 10 to 30 carbon atoms, in some examples from 15 to 25 carbon atoms, in some examples from 12 to 20 carbon atoms, in some example from 16 to 20 carbon atoms, in some examples from 21 to 30 carbon atoms, in some examples from 21 to 25 carbon atoms. It has been found that when the number of carbon atoms is from 12 to 20, this seems to promote the improvement of the transfer properties of the ink. In some examples, it has been found that when the number of carbon atoms is from 21 to 30, this seems to promote the peel resistance. The hydrocarbon-containing side chains may comprise a group selected from an alkyl, alkenyl, alkynyl, aryl, alkaryl and arylakyl.

The hydrocarbon side chains may, in some examples, be substituted with a substituent. In some examples, the graft co-polymer has alkyl-containing side chains. The alkyl-containing side chains may be linked to the acrylate moieties of the polymer backbone and/or the polysiloxane side chains, in some examples via an organic linker group, for example a group selected from an ester, ether, amino and amido groups. The alkyl-containing side chains may terminate with an alkyl group. In some examples, the graft co-polymer has C10 to C30 alkyl-containing side chains. In some examples, the graft co-polymer has C15 to C25 alkyl-containing side chains. In some examples, the graft co-polymer has C16 to C20 alkyl-containing side chains, e.g. C17, C18 or C19 alkyl-containing side chains. In some examples, the graft co-polymer has C21 to C30 alkyl-containing side chains. In some examples, the graft co-polymer has C21 to C25 alkyl-containing side chains, e.g. C22, C23 or C24 alkyl-containing side chains.

The polysiloxane side chains contain siloxane repeating units. In some examples, the polysiloxane side chains comprise dialkylpolysiloxane repeating units. In some examples, the polysiloxane side chains are linked to the polymer backbone, e.g. acrylate repeating units of the polymer backbone, via an organic linker group, for example a group selected from an ester, ether, amino and amido groups.

In some examples, the graft co-polymer is formed from C10 to C30 alkyl acrylate monomers, which form at least part of the polymer backbone, and dialkylpolysiloxane repeating units, which form at least part of the polysiloxane side chains. In some examples, the graft co-polymer is formed from C16 to C20 alkyl acrylate monomers, in some examples C21 to C30 alkyl acrylate monomers, in some examples C21 to C25 alkyl-containing side chains, which form at least part of the polymer backbone, and dialkylpolysiloxane repeating units, which form at least part of the polysiloxane side chains.

In some examples, the graft co-polymer is formed from a fatty acid acrylate monomer and a silicone acrylate monomer, in some examples with one or more other types of acrylate monomer. In some examples, the fatty acid acrylate monomer is selected from a caprylyl acrylate monomer, a capryl acrylate monomer, a lauryl acrylate monomer, a myristyl acrylate monomer, a palmityl acrylate monomer, a stearyl acrylate monomer, an arachidyl acrylate monomer, a behenyl acrylate monomer, a lignoceryl acrylate monomer and cerotyl acrylate monomer. In some examples, the graft co-polymer is formed from a stearyl acrylate monomer and a dimethylsilicone acrylate monomer, in some examples with one or more other types of acrylate monomer. In some examples, the graft co-polymer is formed from a behenyl acrylate monomer and a dimethylsilicone acrylate monomer, in some examples with one or more other types of acrylate monomer. A dimethyl silicone is sometimes termed a dimethicone.

In some examples, the graft co-polymer has a melting point of from about 10° C. to about 100° C., in some examples about 10° C. to about 50° C., about 20° C. to about 40° C., in some examples about about 25° C. to about 35° C., in some examples about 30° C.

Examples of suitable graft co-polymers are available commercially, e.g. from Shit-Etsu Chemical Co., Ltd. under the tradename KP-561P or KP-562P.

In some examples, the electrostatic ink composition contains the graft co-polymer in an amount of at least about 100 ppm, in some examples at least about 300 ppm, in some examples at least about 500 ppm, in some examples at least about 700 ppm, in some examples at least about 1000 ppm.

In some examples, the electrostatic ink composition contains the graft co-polymer in an amount of from about 1000 ppm to about 10,000 ppm, in some examples from about 1000 ppm to about 8000 ppm, in some examples from about 1000 ppm to about 6000 ppm, in some examples from about 2000 ppm to about 5000 ppm, in some examples from about 2000 ppm to about 4000 ppm, in some examples from about 2500 ppm to about 3500 ppm, in some examples about 2800 to about 3200, in some examples about 3000 ppm.

In some examples, the electrostatic ink composition comprises a carrier liquid. In some examples, particles comprising the graft co-polymer, and in some examples the resin, are suspended or dispersed in the carrier liquid. Generally, the carrier liquid can act as a dispersing medium for the other components in the electrostatic ink. For example, the carrier liquid can comprise or be a hydrocarbon, silicone oil, vegetable oil, etc. The carrier liquid can include, but is not limited to, an insulating, non-polar, non-aqueous liquid that is used as the medium for toner particles. The carrier liquid can include compounds that have a resistivity in excess of about $10^9$ ohm-cm. The carrier liquid may have a dielectric constant below about 5, in some examples below about 3. The carrier liquid can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof. Examples of the carrier liquids include, but are not limited to, aliphatic hydrocarbons, isoparaffinic compounds, paraffinic compounds, dearomatized hydrocarbon compounds, and the like. In particular, the carrier liquids can include, but are not limited to, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™ Nisseki Isosol 400™ AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™)

The carrier liquid can constitute about 20% to 99.5% by weight of the electrostatic ink composition, in some examples 50% to 99.5% by weight of the electrostatic ink composition. The carrier liquid may constitute about 40 to 90% by weight of the electrostatic ink composition. The carrier liquid may constitute about 60% to 80% by weight of the electrostatic ink composition. The carrier liquid may constitute about 90% to 99.5% by weight of the electrostatic ink composition, in some examples 95% to 99% by weight of the electrostatic ink composition.

The electrostatic ink comprising a graft co-polymer comprising an acrylate polymer backbone onto which has been grafted polysiloxane side chains, when printed on the print substrate, may be substantially free from carrier liquid. In an electrostatic printing process and/or afterwards, the carrier liquid may be removed, e.g. by an electrophoresis processes during printing and/or evaporation, such that substantially just solids are transferred to a substrate, e.g. the final substrate or print substrate. Substantially free from carrier liquid may indicate that the ink printed on the print substrate contains less than 5 wt % carrier liquid, in some examples, less than 2 wt % carrier liquid, in some examples less than 1 wt % carrier liquid, in some examples less than 0.5 wt % carrier liquid. In some examples, the ink printed on the print substrate is free from carrier liquid.

The electrostatic ink composition may further comprise a resin. In some examples, the particles comprising the graft co-polymer in the electrostatic ink composition may further comprise a resin. The resin in the electrostatic ink composition and/or the ink printed on the print substrate can comprise a polymer including, but not limited to, a thermoplastic polymer. A thermoplastic polymer is sometimes referred to as a thermoplastic resin. In some examples, the polymer may be selected from ethylene or propylene acrylic acid co-polymers; ethylene or propylene methacrylic acid co-polymers; ethylene or propylene acrylic acid co-polymers; ethylene vinyl acetate co-polymers; co-polymers of ethylene or propylene (e.g. 80 wt % to 99.9 wt %), and alkyl (e.g. C1 to C5) ester of methacrylic or acrylic acid (e.g. 0.1 wt % to 20 wt %); co-polymers of ethylene (e.g. 80 wt % to 99.9 wt %), acrylic or methacrylic acid (e.g. 0.1 wt % to 20.0 wt %) and alkyl (e.g. C1 to C5) ester of methacrylic or acrylic acid (e.g. 0.1 wt % to 20 wt %); co-polymers of ethylene or propylene (e.g. 70 wt % to 99.9 wt %) and maleic anhydride (e.g. 0.1 wt % to 30 wt %); polyethylene; polystyrene; isotactic polypropylene (crystalline); co-polymers of ethylene ethylene ethyl acrylate; polyesters; polyvinyl toluene; polyamides; styrene/butadiene co-polymers; epoxy resins; acrylic resins (e.g. co-polymer of acrylic or methacrylic acid and at least one alkyl ester of acrylic or methacrylic acid wherein alkyl may have from 1 to about 20 carbon atoms, such as methyl methacrylate (e.g. 50% to 90%)/methacrylic acid (e.g. 0 wt % to 20 wt %)/ethylhexylacrylate (e.g. 10 wt % to 50 wt %)); ethylene-acrylate terpolymers: ethylene-acrylic esters-maleic anhydride (MAH) or glycidyl methacrylate (GMA) terpolymers; ethylene-acrylic acid ionomers and combinations thereof.

The resin may comprise a polymer having acidic side groups. Examples of the polymer having acidic side groups will now be described. The polymer having acidic side groups may have an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer having acidic side groups may have an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures known in the art, for example using the procedure described in ASTM D1386.

The resin may comprise a polymer, in some examples a polymer having acidic side groups, that has a melt flow rate of less than about 70 g/10 minutes, in some examples about 60 g/10 minutes or less, in some examples about 50 g/10 minutes or less, in some examples about 40 g/10 minutes or less, in some examples 30 g/10 minutes or less, in some examples 20 g/10 minutes or less, in some examples 10 g/10 minutes or less. In some examples, all polymers having acidic side groups and/or ester groups in the particles each individually have a melt flow rate of less than 90 g/10 minutes, 80 g/10 minutes or less, in some examples 80 g/10 minutes or less, in some examples 70 g/10 minutes or less, in some examples 70 g/10 minutes or less, in some examples 60 g/10 minutes or less.

The polymer having acidic side groups can have a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. The polymer having acidic side groups can have a melt flow rate of, in some examples, about 50 g/10 minutes to about 120 g/10 minutes, in some examples 60 g/10 minutes to about 100 g/10 minutes. The melt flow rate can be measured using standard procedures known in the art, for example as described in ASTM D1238.

The acidic side groups may be in free acid form or may be in the form of an anion and associated with one or more counterions, typically metal counterions, e.g. a metal selected from the alkali metals, such as lithium, sodium and potassium, alkali earth metals, such as magnesium or calcium, and transition metals, such as zinc. The polymer having acidic sides groups can be selected from resins such as co-polymers of ethylene and an ethylenically unsaturated acid of either acrylic acid or methacrylic acid; and ionomers thereof, such as methacrylic acid and ethylene-acrylic or methacrylic acid co-polymers which are at least partially neutralized with metal ions (e.g. Zn, Na, Li) such as SURLYN® ionomers. The polymer comprising acidic side groups can be a co-polymer of ethylene and an ethylenically unsaturated acid of either acrylic or methacrylic acid, where the ethylenically unsaturated acid of either acrylic or methacrylic acid constitute from 5 wt % to about 25 wt % of the co-polymer, in some examples from 10 wt % to about 20 wt % of the co-polymer.

The resin may comprise two different polymers having acidic side groups. The two polymers having acidic side groups may have different acidities, which may fall within the ranges mentioned above. The resin may comprise a first polymer having acidic side groups that has an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has an acidity of 110 mg KOH/g to 130 mg KOH/g.

The resin may comprise two different polymers having acidic side groups: a first polymer having acidic side groups that has a melt flow rate of about 10 g/10 minutes to about 50 g/10 minutes and an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has a melt flow rate of about 50 g/10 minutes to about 120 g/10 minutes and an acidity of 110 mg KOH/g to 130 mg KOH/g. The first and second polymers may be absent of ester groups.

The ratio of the first polymer having acidic side groups to the second polymer having acidic side groups can be from about 10:1 to about 2:1. The ratio can be from about 6:1 to about 3:1, in some examples about 4:1.

The resin may comprise a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; said polymer may be a polymer having acidic side groups as described herein. The resin may comprise a first polymer having a melt viscosity of 15000 poise or more, in some examples 20000 poise or more, in some examples 50000 poise or more, in some examples 70000 poise or more; and in some examples, the resin may comprise a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The resin may comprise a first polymer having a melt viscosity of more than 60000 poise, in some examples from 60000 poise to 100000 poise, in some examples from 65000 poise to 85000 poise; a second polymer having a melt viscosity of from 15000 poise to 40000 poise, in some examples 20000 poise to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; an example of the first polymer is Nucrel 960 (from DuPont), and example of the second polymer is Nucrel 699 (from DuPont), and an example of the third polymer is AC-5120 or AC-5180 (from Honeywell). The first, second and third polymers may be polymers having acidic side groups as described herein. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

If the resin in electrostatic ink or ink composition comprises a single type of polymer, the polymer (excluding any other components of the electrostatic ink composition) may have a melt viscosity of 6000 poise or more, in some examples a melt viscosity of 8000 poise or more, in some examples a melt viscosity of 10000 poise or more, in some examples a melt viscosity of 12000 poise or more. If the resin comprises a plurality of polymers all the polymers of the resin may together form a mixture (excluding any other components of the electrostatic ink composition) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

The resin may comprise two different polymers having acidic side groups that are selected from co-polymers of ethylene and an ethylenically unsaturated acid of either acrylic acid; and ionomers thereof, such as methacrylic acid and ethylene-acrylic or methacrylic acid co-polymers which are at least partially neutralized with metal ions (e.g. Zn, Na, Li) such as SURLYN® ionomers. The resin may comprise (i) a first polymer that is a co-polymer of ethylene and an ethylenically unsaturated acid of either acrylic acid and methacrylic acid, wherein the ethylenically unsaturated acid of either acrylic or methacrylic acid constitutes from 8 wt % to about 16 wt % of the co-polymer, in some examples 10 wt % to 16 wt % of the co-polymer; and (ii) a second polymer that is a co-polymer of ethylene and an ethylenically unsaturated acid of either acrylic acid and methacrylic acid, wherein the ethylenically unsaturated acid of either acrylic or methacrylic acid constitutes from 12 wt % to about 30 wt % of the co-polymer, in some examples from 14 wt % to about 20 wt % of the co-polymer, in some examples from 16 wt % to about 20 wt % of the co-polymer in some examples from 17 wt % to 19 wt % of the co-polymer.

The resin may comprise a polymer having acidic side groups, as described above (which may be free of ester side groups), and a polymer having ester side groups. The polymer having ester side groups may be a thermoplastic polymer. The polymer having ester side groups may further comprise acidic side groups. The polymer having ester side groups may be a co-polymer of a monomer having ester side groups and a monomer having acidic side groups. The polymer may be a co-polymer of a monomer having ester side groups, a monomer having acidic side groups, and a monomer absent of any acidic and ester side groups. The monomer having ester side groups may be a monomer selected from esterified acrylic acid or esterified methacrylic acid. The monomer having acidic side groups may be a monomer selected from acrylic or methacrylic acid. The monomer absent of any acidic and ester side groups may be an alkylene monomer, including, but not limited to, ethylene or propylene. The esterified acrylic acid or esterified methacrylic acid may, respectively, be an alkyl ester of acrylic acid or an alkyl ester of methacrylic acid. The alkyl group in the alkyl ester of acrylic or methacrylic acid may be an alkyl group having 1 to 30 carbons, in some examples 1 to 20 carbons, in some examples 1 to 10 carbons; in some examples selected from methyl, ethyl, iso-propyl, n-propyl, t-butyl, iso-butyl, n-butyl and pentyl.

The polymer having ester side groups may be a co-polymer of a first monomer having ester side groups, a second monomer having acidic side groups and a third monomer which is an alkylene monomer absent of any acidic and ester side groups. The polymer having ester side groups may be a co-polymer of (i) a first monomer having ester side groups selected from esterified acrylic acid or esterified methacrylic acid, in some examples an alkyl ester of acrylic or methacrylic acid, (ii) a second monomer having acidic side groups selected from acrylic or methacrylic acid and (iii) a third monomer which is an alkylene monomer selected from ethylene and propylene. The first monomer may constitute 1% to 50% by weight of the co-polymer, in some examples 5% to 40% by weight, in some examples 5% to 20% by weight of the co-polymer, in some examples 5% to 15% by weight of the co-polymer. The second monomer may constitute 1% to 50% by weight of the co-polymer, in some examples 5% to 40% by weight of the co-polymer, in some examples 5% to 20% by weight of the co-polymer, in some examples 5% to 15% by weight of the co-polymer. The first monomer can constitute 5% to 40% by weight of the co-polymer, the second monomer constitutes 5% to 40% by weight of the co-polymer, and with the third monomer constituting the remaining weight of the co-polymer. In some examples, the first monomer constitutes 5% to 15% by weight of the co-polymer, the second monomer constitutes 5% to 15% by weight of the co-polymer, with the third monomer constituting the remaining weight of the co-polymer. In some examples, the first monomer constitutes 8% to 12% by weight of the co-polymer, the second monomer constitutes 8% to 12% by weight of the co-polymer, with the third monomer constituting the remaining weight of the co-polymer. In some examples, the first monomer constitutes about 10% by weight of the co-polymer, the second monomer constitutes about 10% by weight of the co-polymer, and with the third monomer constituting the remaining weight of the co-polymer. The polymer may be selected from the Bynel® class of monomer, including Bynel 2022 and Bynel 2002, which are available from DuPont®.

The polymer having ester side groups may constitute 1% or more by weight of the total amount of the resin polymers, e.g. thermoplastic resin polymers, in the electrostatic ink composition and/or the ink printed on the print substrate, e.g.

the total amount of the polymer or polymers having acidic side groups and polymer having ester side groups. The polymer having ester side groups may constitute 5% or more by weight of the total amount of the resin polymers, e.g. thermoplastic resin polymers, in some examples 8% or more by weight of the total amount of the resin polymers, e.g. thermoplastic resin polymers, in some examples 10% or more by weight of the total amount of the resin polymers, e.g. thermoplastic resin polymers, in some examples 15% or more by weight of the total amount of the resin polymers, e.g. thermoplastic resin polymers, in some examples 20% or more by weight of the total amount of the resin polymers, e.g. thermoplastic resin polymers, in some examples 25% or more by weight of the total amount of the resin polymers, e.g. thermoplastic resin polymers, in some examples 30% or more by weight of the total amount of the resin polymers, e.g. thermoplastic resin polymers, in some examples 35% or more by weight of the total amount of the resin polymers, e.g. thermoplastic resin polymers, in the electrostatic ink composition and/or the ink printed on the print substrate. The polymer having ester side groups may constitute from 5% to 50% by weight of the total amount of the resin polymers, e.g. thermoplastic resin polymers, in the electrostatic ink composition and/or the ink printed on the print substrate, in some examples 10% to 40% by weight of the total amount of the resin polymers, e.g. thermoplastic resin polymers, in the electrostatic ink composition and/or the ink printed on the print substrate, in some examples 5% to 30% by weight of the total amount of the resin polymers, e.g. thermoplastic resin polymers, in the electrostatic ink composition and/or the ink printed on the print substrate, in some examples 5% to 15% by weight of the total amount of the resin polymers, e.g. thermoplastic resin polymers, in the electrostatic ink composition and/or the ink printed on the print substrate in some examples 15% to 30% by weight of the total amount of the resin polymers, e.g. thermoplastic resin polymers, in the electrostatic ink composition and/or the ink printed on the print substrate.

The polymer having ester side groups may have an acidity of 50 mg KOH/g or more, in some examples an acidity of 60 mg KOH/g or more, in some examples an acidity of 70 mg KOH/g or more, in some examples an acidity of 80 mg KOH/g or more. The polymer having ester side groups may have an acidity of 100 mg KOH/g or less, in some examples 90 mg KOH/g or less. The polymer having ester side groups may have an acidity of 60 mg KOH/g to 90 mg KOH/g, in some examples 70 mg KOH/g to 80 mg KOH/g.

The polymer having ester side groups may have a melt flow rate of about 10 g/10 minutes to about 120 g/10 minutes, in some examples about 10 g/10 minutes to about 50 g/10 minutes, in some examples about 20 g/10 minutes to about 40 g/10 minutes, in some examples about 25 g/10 minutes to about 35 g/10 minutes.

The polymer, polymers, co-polymer or co-polymers of the resin can in some examples be selected from the Nucrel family of toners (e.g. Nucrel 403™, Nucrel 407™ Nucrel 609HS™, Nucrel 908HS™, Nucrel 1202HC™, Nucrel 30707™ Nucrel 1214™, Nucrel 903™, Nucrel 3990™ Nucrel 910™ Nucrel 925™ Nucrel 699™ Nucrel 599™ Nucrel 960™, Nucrel RX 76™, Nucrel 2806™, Bynell 2002, Bynell 2014, and Bynell 2020 (sold by E. I. du PONT)), the Aclyn family of toners (e.g. Aaclyn 201, Aclyn 246, Aclyn 285, and Aclyn 295), and the Lotader family of toners (e.g. Lotader 2210, Lotader, 3430, and Lotader 8200 (sold by Arkema)).

The resin can constitute about 5 to 90%, in some examples about 50 to 80%, by weight of the solids of the electrostatic ink composition and/or the ink printed on the print substrate. The resin can constitute about 60 to 95%, in some examples about 70 to 95%, by weight of the solids of the electrostatic ink composition and/or the ink printed on the print substrate.

The electrostatic ink composition and/or ink printed on the print substrate can comprise a charge director. A charge director can be added to an electrostatic ink composition to impart a charge of a desired polarity and/or maintain sufficient electrostatic charge on the particles of an electrostatic ink composition. The charge director may comprise ionic compounds, including, but not limited to, metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc. The charge director can be selected from, but is not limited to, oil-soluble petroleum sulfonates (e.g. neutral Calcium Petronate™, neutral Barium Petronate™, and basic Barium Petronate™), polybutylene succinimides (e.g. OLOA™ 1200 and Amoco 575), and glyceride salts (e.g. sodium salts of phosphated mono- and diglycerides with unsaturated and saturated acid substituents), sulfonic acid salts including, but not limited to, barium, sodium, calcium, and aluminum salts of sulfonic acid. The sulfonic acids may include, but are not limited to, alkyl sulfonic acids, aryl sulfonic acids, and sulfonic acids of alkyl succinates (e.g. see WO 2007/130069). The charge director can impart a negative charge or a positive charge on the resin-containing particles of an electrostatic ink composition.

The charge director can comprise a sulfosuccinate moiety of the general formula $[R_1—O—C(O)CH_2CH(SO_3^-)OC(O)—O—R_2]$, where each of $R_1$ and $R_2$ is an alkyl group. In some examples, the charge director comprises nanoparticles of a simple salt and a sulfosuccinate salt of the general formula $MA_n$, wherein M is a metal, n is the valence of M, and A is an ion of the general formula $[R_1—O—C(O)CH_2CH(SO_3^-)OC(O)—O—R_2]$, where each of $R_1$ and $R_2$ is an alkyl group, or other charge directors as found in WO2007130069, which is incorporation herein by reference in its entirety. As described in WO2007130069, the sulfosuccinate salt of the general formula $MA_n$ is an example of a micelle forming salt. The charge director may be substantially free or free of an acid of the general formula HA, where A is as described above. The charge director may comprise micelles of said sulfosuccinate salt enclosing at least some of the nanoparticles. The charge director may comprise at least some nanoparticles having a size of 200 nm or less, in some examples 2 nm or more. As described in WO2007130069, simple salts are salts that do not form micelles by themselves, although they may form a core for micelles with a micelle forming salt. The ions constructing the simple salts are all hydrophilic. The simple salt may comprise a cation selected from the group consisting of Mg, Ca, Ba, $NH_4$, tert-butyl ammonium, $Li^+$, and $Al^{+3}$, or from any sub-group thereof. The simple salt may comprise an anion selected from the group consisting of $SO_4^{2-}$, $PO^{3-}$, $NO_3^-$, $HPO_4^{2-}$, $CO_3^{2-}$, acetate, trifluoroacetate (TFA), $Cl^-$, Bf, $F^-$, $ClO_4^-$, and $TiO_3^{4-}$, or from any sub-group thereof. The simple salt may be selected from $CaCO_3$, $Ba_2TiO_3$, $Al_2(SO_4)$, $Al(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)_3$, $LiClO_4$ and $LiBF_4$, or any sub-group thereof. The charge director may further comprise basic barium petronate (BBP).

In the formula $[R_1—O—C(O)CH_2CH(SO_3^-)OC(O)—O—R_2]$, in some examples, each of $R_1$ and $R_2$ is an aliphatic alkyl group. In some examples, each of $R_1$ and $R_2$ independently is a $C_{6-25}$ alkyl. In some examples, said aliphatic alkyl group is linear. In some examples, said aliphatic alkyl group is branched. In some examples, said aliphatic alkyl group includes a linear chain of more than 6 carbon atoms. In some examples, $R_1$ and $R_2$ are the same. In some examples, at least one of $R_1$ and $R_2$ is $C_{13}H_{27}$. In some examples, M is Na, K, Cs, Ca, or Ba. The formula $[R_1—O—C(O)CH_2CH(SO_3^-)OC(O)—O—R_2]$ and/or the formula $MA_n$ may be as defined in any part of WO2007130069.

The charge director may comprise (i) soya lecithin, (ii) a barium sulfonate salt, such as basic barium petronate (BPP), and (iii) an isopropyl amine sulfonate salt. Basic barium petronate is a barium sulfonate salt of a 21-26 hydrocarbon alkyl, and can be obtained, for example, from Chemtura. An example isopropyl amine sulphonate salt is dodecyl benzene sulfonic acid isopropyl amine, which is available from Croda.

The charge director can constitute about 0.001% to 20%, in some examples 0.01 to 20% by weight, in some examples 0.01 to 10% by weight, in some examples 0.01 to 1% by weight of the solids of the electrostatic ink composition and/or ink printed on the print substrate. The charge director can constitute about 0.001 to 0.15% by weight of the solids of the electrostatic ink composition and/or ink printed on the print substrate, in some examples 0.001 to 0.15%, in some examples 0.001 to 0.02% by weight of the solids of the electrostatic ink composition and/or ink printed on the print substrate. In some examples, the charge director imparts a negative charge on the electrostatic ink composition. The particle conductivity may range from 50 to 500 pmho/cm, in some examples from 200-350 pmho/cm.

The electrostatic ink composition and/or ink printed on the print substrate can include a charge adjuvant. A charge adjuvant may be present with a charge director, and may be different to the charge director, and act to increase and/or stabilise the charge on particles, e.g. resin-containing particles, of an electrostatic ink composition. The charge adjuvant can include, but is not limited to, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Cu salts of stearic acid, Fe salts of stearic acid, metal carboxylates (e.g. Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock co-polymers of 2-ethylhexyl methacrylate-co-methacrylic acid calcium, and ammonium salts, co-polymers of an alkyl acrylamidoglycolate alkyl ether (e.g. methyl acrylamidoglycolate methyl ether-co-vinyl acetate), and hydroxy bis(3,5-di-tert-butyl salicylic) aluminate monohydrate. In some examples, the charge adjuvant is aluminum di and/or tristearate and/or aluminum di and/or tripalmitate.

The charge adjuvant can constitute about 0.1 to 5% by weight of the solids of the electrostatic ink composition and/or ink printed on the print substrate. The charge adjuvant can constitute about 0.5 to 4% by weight of the solids of the electrostatic ink composition and/or ink printed on the print substrate. The charge adjuvant can constitute about 1 to 3% by weight of the solids of the electrostatic ink composition and/or ink printed on the print substrate.

The electrostatic ink composition and/or ink printed on the print substrate may further comprise a colorant. The colorant may be selected from a pigment, dye and a combination thereof. The colorant may be transparent, unicolor or composed of any combination of available colors. The colorant may be selected from a cyan colorant, a yellow colorant, a magenta colorant and a black colorant. The electrostatic ink composition and/or ink printed on the print substrate may comprise a plurality of colorants. The electrostatic ink composition and/or ink printed on the print substrate may comprise a first colorant and second colorant, which are different from one another. Further colorants may also be present with the first and second colorants. The electrostatic ink composition and/or ink printed on the print substrate may comprise first and second colorants where each is independently selected from a cyan colorant, a yellow colorant, a magenta colorant and a black colorant. In some examples, the first colorant comprises a black colorant, and the second colorant comprises a non-black colorant, for example a colorant selected from a cyan colorant, a yellow colorant and a magenta colorant. The colorant may be selected from a phthalocyanine colorant, an indigold colorant, an indanthrone colorant, a monoazo colorant, a diazo colorant, inorganic salts and complexes, dioxazine colorant, perylene colorant, anthraquinone colorants, and any combination thereof.

In some examples, there is provided a method of manufacturing an electrostatic ink composition, the method comprising mixing the particles comprising a graft co-polymer comprising an acrylate polymer backbone onto which has been grafted polysiloxane side chains and the carrier liquid. In some examples, the method involves mixing a resin, which may be as described herein, and a graft co-polymer comprising an acrylate polymer backbone onto which has been grafted polysiloxane side chains, in some examples in the presence of the carrier liquid, under shear conditions to produce particles comprising the resin and the graft co-polymer comprising an acrylate polymer backbone onto which has been grafted polysiloxane side chains. "Particles comprising the resin and the graft co-polymer comprising an acrylate polymer backbone onto which has been grafted polysiloxane side chains as described herein, indicates that at least some, in some examples all, of the particles comprise both the resin and the graft co-polymer comprising an acrylate polymer backbone onto which has been grafted polysiloxane side chains. The shear conditions may involve grinding the resin and the graft co-polymer comprising an acrylate polymer backbone onto which has been grafted polysiloxane side chains, e.g. in a ball mill or a grinder, which may be in the presence of a carrier liquid.

In some examples, the method of manufacturing may comprise mixing a resin, the graft co-polymer comprising an acrylate polymer backbone onto which has been grafted polysiloxane side chains and a carrier liquid under appropriate conditions, to form particles, comprising the resin and the graft co-polymer comprising an acrylate polymer backbone onto which has been grafted polysiloxane side chains, that are suspended within the carrier liquid, and, in some examples, mixing a charge director with the carrier liquid.

One or more further additives as described herein may be added at any time during the method. The steps described above are not intended to be bound by any particular order. For example, the mixing of the resin with the carrier liquid may be performed before, after, or concurrently with the step of combining the charge director with the carrier liquid and/or before, after, or concurrently with the step of combining the graft co-polymer comprising an acrylate polymer backbone onto which has been grafted polysiloxane side chains with the carrier liquid. Additionally, the steps may be combined or performed in a different order. Additionally, the steps may include other processing steps. In some examples, the step of combining the graft co-polymer comprising an acrylate polymer backbone onto which has been grafted polysiloxane side chains with the resin can include grinding the resin and the graft co-polymer comprising an acrylate polymer backbone onto which has been grafted polysiloxane side chains, which may form particles comprising the resin and the graft co-polymer comprising an acrylate polymer backbone onto which has been grafted polysiloxane side chains.

In some examples, the surface on which the (latent) electrostatic image is formed or developed may be on a rotating member, e.g. in the form of a cylinder. The surface on which the (latent) electrostatic image is formed or developed may form part of a photo imaging plate (PIP). The method may involve passing the electrostatic ink composition between a stationary electrode and a rotating member, which may be a member having the surface having the (latent) electrostatic image thereon or a member in contact with the surface having the (latent) electrostatic image thereon. A voltage is applied between the stationary electrode and the rotating member, such that particles, e.g. comprising a resin and the graft co-polymer comprising an acrylate polymer backbone onto which has been grafted polysiloxane side chains, adhere to the surface of the rotating member.

The intermediate transfer member, if present, may be a rotating flexible member, which may be heated, e.g. to a temperature of from 80 to 160° C.

The print or final substrate may be any suitable substrate. The substrate may be any suitable substrate capable of having an image printed thereon. The substrate may comprise a material selected from an organic or inorganic material. The material may comprise a natural polymeric material, e.g. cellulose. The material may comprise a synthetic polymeric material, e.g. a polymer formed from alkylene monomers, including, but not limited to, polyethylene and polypropylene, and co-polymers such as styrene-polybutadiene. The material may comprise a metal, which may be in sheet form. The metal may be selected from or made from, for instance, aluminum (Al), silver (Ag), tin (Sn), copper (Cu), mixtures thereof. In some examples, the substrate comprises a cellulosic paper. In some examples, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The substrate is in some examples a cellulosic print substrate such as paper. The cellulosic print substrate is in some examples a coated cellulosic print substrate, e.g. having a coating of a polymeric material thereon.

EXAMPLES

The following illustrates examples of the methods and compositions described herein. Thus, these examples should not be considered as limitations of the present disclosure, but are merely in place to teach how to make examples of compositions of the present disclosure.

Production of Toner Particles

Toner particles were produced so that they contained the resins Nucrel 925, Nucrel 2806 and Bynel 2022 in the weight proportions 72:18:10.

The general procedure for producing the resin particles is described below.

As a first step, all resins as listed above were mixed in a Ross double planetary mixer with 1500 grams of Isopar L (an iso-parfinic oil manufactured by EXXON) carrier liquid at a speed of 60 rpm and a temperature of 130° C. for one hour. The total amount of resins in each case was 1000 g. The temperature was then reduced and mixing continued until the mixture reaches room temperature. During mixing the polymer solvates the Isopar and during the cooling granules of polymer (with solvated carrier liquid) in carrier liquid are produced.

As a second step, 1000 grams of the mixture produced in the first step is charged into a Union Process 1S ball atritor together with 5 grams of aluminium tri-stearate (Riedel de-Haan) as a charge adjuvant and 92 grams of the pigment Monarch 800 (available from CABOT), and Alkali Blau D 6200 from BASF at a ratio of 15 to 3 respectively. The mixture is ground for 2 hours at 55° C., followed by grinding for 10 hours at 40° C. until a toner concentrate having toner particles incorporating the adjuvant and pigments is produced.

The toner concentrate made above containing the resin particles is charged utilizing mg/g of charge director and diluted with additional Isopar L to produce a toner having a 2% NVS, with 98% of the carrier liquid being Isopar L. The charge director was a barium bis sulfosuccinate salt, as described in US 2009/0311614. Other charge directors as known in the art can also be used. Wax particles suspended in Isopar-L in a weight percentage of 4.5% with respect to the NVS of the toner particles were added. The wax was a polyethylene wax, Acumist B6, available from Honeywell.

Two different electrostatic ink compositions were made in accordance with the method described above: a first composition which further contained an example of a graft co-polymer comprising an acrylate polymer backbone onto which has been grafted polysiloxane side chains (the additive KP-561P, available from Shin-Etsu Chemical Co., Ltd.; this additive is termed "EM16" below), and a second composition which lacked this additive (the reference example). In particular, the first composition was prepared in accordance with the method described above, and included the above-mentioned EM16 additive in an amount of 3000 ppm, which was added to the working dispersion on the press. As described, the toner particles contained the resins Nucrel 925, Nucrel 2806 and Bynel 2022 in the weight proportions 72:18:10. The charge director used was, as described above, a barium bis sulfosuccinate salt.

A typical experiment included performing a series of image impressions on a HP Indigo 7000 printer with a standard (Gemini) blanket using this ink. In order to test the impact of the additives on ink transfer to substrate and to evaluate possible side-effects, the following test procedures are used:

Stage 1: Screening

Stage 1a: Offline Screening of Candidates

Stage 1 b: Initial Press Screening of Chosen Additives (Single-Substrate Runs).

This test focuses on the issue of ink development in non-image areas, called background development. This background development is a "bug" in initial image creation between the BID and the PIP. Its impact begins once this background is transferred from the PIP to the blanket.

Outputs of test:

Levels of background visible on print

Levels of background accumulation on blanket

Cleanability of accumulated background

Blanket memories (solid K, small dots)—sanity only

Ink fixing to substrate—sanity only

As T1 (transfer from PIP to blanket) and T2 (transfer from blanket to substrate) of developed background are strongly release-dependant, these outputs were obtained for the various blanket histories.

The results were analyzed to identify useful additives, what types of improvements that may be obtained by each, and to understand improvement mechanisms.

Stage 2: Expanded Transferability Test (Multi-Substrate Runs)

Outputs:

T2 of grays in BOB areas with & without cleaning

Dot gain memory

Gloss & OD memories

Printing problems in areas of edges of ex-image areas (stress through simulation of creep & misregistration)

Ink fixing to substrate (short internal comparison test, more elaborate than the sanity test in stage 1 b).

Impact on T1 operating window and on T1 memories

Short-term wetness memory (a short-term dot-gain memory)

Stage 3: Full Transferability & Side-Effects Test (Multi-Substrate Runs)

Outputs:

Image T2 failures

T1 window at early-blanket-life and with aged blanket

Monitoring of assorted blanket memories (Gloss, OD, dot-gain and small-dot memories Assessment of expected PQ issues "Customer job" failures Full assessment of ink fixing and durability on substrate Effect of the Additive EM16:

EM16 at a concentration of about 3000 ppm was seen to decrease the deterioration in the efficiency of ink transfer from the blanket to the substrate. The results are summarized in the graphs of FIGS. 1 and 2. In these figures, the reference ink is termed 'Rev4', i.e. lacking the EM16 additive. 'Rev4+ EM16' indicates the same liquid toner composition, but further comprising the EM16 additive.

FIG. 1 illustrates 'Background accumulation On Blanket' (BOB). At the end of each stage, the BOB is cleaned off the blanket and measured. This graph shows the delayed increase in background accumulation due to the addition of EM16.

Figure 2:
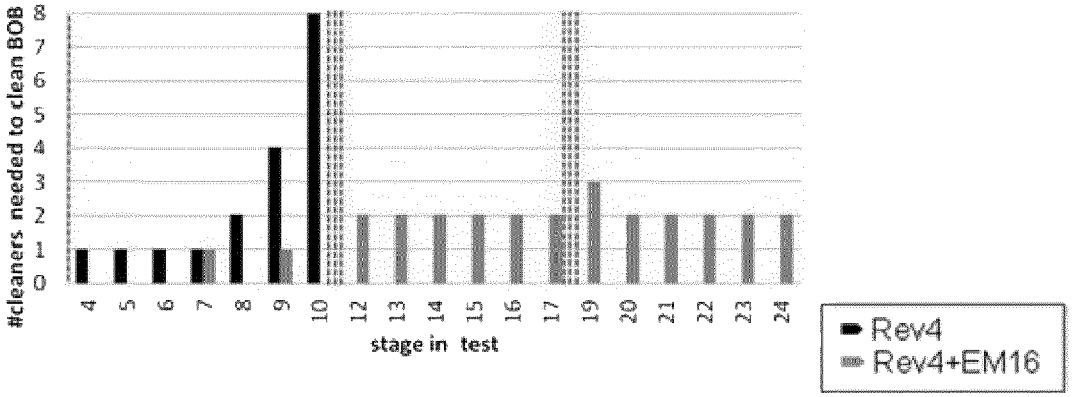
FIG. 2 illustrates the results of cleanability tests on an example ink composition as described herein, i.e. containing a graft co-polymer comprising an acrylate polymer backbone onto which has been grafted polysiloxane side chains. The graph of this Figure shows high cleaning efficiency of the example ink, even at high levels of background accumulation.

FIG. 2 illustrates cleanability. This graph shows high cleaning efficiency, even at high levels of background accumulation.

Adhesion Resistance of Various LEP Inks

An ink was prepared in accordance with the method described above, except that it contained the additive KP-562P, from Shin-Etsu Chemical Co., Ltd in an amount of 3000 ppm instead of the KP-561P additive. KP-561P is an acrylates/stearyl acrylate/dimethicone methacrylate copolymer, whereas KP-562P is an acrylates/behenyl acrylate/dimethicone methacrylate copolymer. The inks containing the KP-561P and KP-562P additives were tested for adhesion resistance using a 180° angle peeling test. Generally, peeling tests evaluate adhesion of ink to substrate using pressure sensitive adhesive tape. Generally, a strip of adhesive tape is applied on heavy (100%) coverage freshly printed images and then removed. Damage to the image characterizes the extent of adhesion/scratch resistance between the image and the paper.

Specifically, the ink containing the EM16 additive was evaluated using the following procedures. First, strips of 100% ink coverage were printed and were prepared for 10 minute tests. The 10 minute test refers to the present peel test that is performed 10 minutes after the ink is printed on the substrate. Six inches of standard adhesive tape (3M 230, 1 inch (2.54 cm) wide) were placed over the printed ink and a standard (2 Kg Rubber covered) roller was rolled over the tape 5 times back and forth. Six printed images were tested for the ink lacking the EM16 additive and 6 printed images for the ink containing the EM16 additive. After 10 minutes, the tape was removed and the resulting substrate was analyzed using specially designed software which measured the percentage of ink-free area created after removal of the ink from the substrate by the adhesive tape. An analogous procedure was used to test the ink containing the KP-562P additive.

The results of the peeling tests of the inks containing the EM16 (KP-561P) additive when compared to the comparative inks (without the additive) showed that the inks having the additive provided much better adhesion. Even better results were seen for the ink containing the KP-562P additive.

While the compositions, methods and related aspects have been described with reference to certain examples, those skilled in the art will appreciate that various modifications, changes, omissions, and substitutions can be made without departing from the spirit of the disclosure. It is intended, therefore, that the compositions, methods and related aspects be limited by the scope of the following claims. The features of any dependent claim may be combined with the features of any of the independent claims or other dependent claims.

The invention claimed is:

1. An electrostatic ink composition comprising a carrier liquid, particles comprising a graft co-polymer comprising an acrylate polymer backbone onto which has been grafted polysiloxane side chains, wherein the particles are dispersed in the carrier liquid.

2. An electrostatic ink composition according to claim 1, wherein the the graft co-polymer has alkyl-containing side chains.

3. An electrostatic ink composition according to claim 1, wherein the particles further comprise a thermoplastic resin comprising a polymer having ester side groups.

4. An electrostatic ink composition according to claim 1, wherein the electrostatic ink composition comprises a charge director selected from a sulfosuccinate moiety and a lecithin-containing species.

5. A method of printing, the method comprising providing an electrostatic ink composition comprising a carrier liquid, and particles comprising a graft co-polymer comprising an acrylate polymer backbone onto which has been grafted polysiloxane side chains, wherein the particles are dispersed in the carrier liquid;

forming a latent electrostatic image on a surface;

contacting the surface with the electrostatic ink composition, such that at least some of the particles are transferred to the surface to form a developed toner image on the surface; and transferring the toner image from the surface to a print substrate.

6. A method according to claim 5, wherein the graft co-polymer has alkyl-containing side chains.

7. A method according to claim 5, wherein the graft co-polymer has C10 to C30 alkyl-containing side chains.

8. A method according to claim 5, wherein the polysiloxane side chains contain dialkylpolysiloxane repeating units.

9. A method according to claim 5, wherein the graft co-polymer is formed from C10 to C30 alkyl acrylate monomers, which form at least part of the polymer backbone, and dialkylpolysiloxane repeating units, which form at least part of the polysiloxane side chains.

10. A method according to claim 5, wherein the electrostatic ink composition contains the graft co-polymer in an amount of at least 1000 ppm.

11. A method according to claim 5, wherein the particles are transferred from the surface to the print substrate via an intermediate transfer member.

12. A method according to claim 5, wherein the particles further comprise a thermoplastic resin comprising a polymer having ester side groups.

13. A method according to claim 5, wherein the particles further comprise a thermoplastic resin comprising (a) a co-polymer of an alkylene monomer and a monomer selected from acrylic acid and methacrylic acid, and (b) a co-polymer of (i) a first monomer having ester side groups selected from esterified acrylic acid or esterified methacrylic acid (ii) a second monomer having acidic side groups selected from acrylic or methacrylic acid and (iii) a third monomer which is an alkylene monomer selected from ethylene and propylene.

14. A method according to claim 5, wherein the electrostatic ink composition comprises a charge director selected from a sulfosuccinate moiety and a lecithin-containing species.

* * * * *